United States Patent [19]

Cardenas et al.

[11] Patent Number: 4,860,667

[45] Date of Patent: Aug. 29, 1989

[54] DISASSEMBLABLE CORRUGATED BOARD TABLE

[75] Inventors: Alfonso Cardenas, Pico Rivera; Juan de la Cruz, Huntington Park, both of Calif.

[73] Assignee: Sunclipse, Inc., Montebello, Calif.

[21] Appl. No.: 256,737

[22] Filed: Oct. 12, 1988

[51] Int. Cl.[4] ..... A47B 3/00

[52] U.S. Cl. ..... 108/115; 108/111

[58] Field of Search ..... 108/111, 153, 115, 51.3

[56] References Cited

U.S. PATENT DOCUMENTS

| | | | |
|---|---|---|---|
| 3,438,345 | 4/1969 | Lasaine et al. | 108/115 |
| 3,490,394 | 1/1970 | Perkins et al. | 108/115 |
| 3,592,143 | 7/1971 | Krone | 108/115 |
| 3,766,864 | 10/1973 | Baker et al. | 108/111 |
| 4,632,345 | 12/1986 | Barley | 108/111 X |

*Primary Examiner*—Peter A. Aschenbrenner

*Attorney, Agent, or Firm*—Vernon D. Beehler; William H. Pavitt, Jr.; Ralf H. Siegemund

[57] ABSTRACT

An assemblable and disassemblable table formed by a die-cut rectangular sheet of corrugated paper board having pieces removed from its corners and central side areas to leave four pairs of oppositely projecting members, each of which pairs is bisected by first creases for inward folding and to define the table top with further 45 degree angle creasing extending outwardly from the intersections of the first creases. Each member is slotted at its extremity so that, when folded inwardly its slotting registers with the slotting of an adjacent most proximate member, one side of which folds into abutment with it to constitute a table leg when secured by a further slotted rectangular element bent at a 90 degree angle along a bisecting crease line and inserted with its slotting interlocking with the registering slotting of abutting members.

3 Claims, 1 Drawing Sheet

DISASSEMBLABLE CORRUGATED BOARD TABLE

FIELD OF THE INVENTION

This invention relates to the broad field of furniture, with particular reference to tables of a type which can be inexpensively fabricated from a corrugated board, may be carried in a thin, flattened state, and readily assembled by simply opening up the flattened element and bringing its leg portions together and securing them in a simple, but effective manner. While the invention may be used for many purposes, it has particular application to providing inexpensive tables for children at home and at school.

BACKGROUND OF THE INVENTION

Tables have been constructed and utilized probably from the beginning of human history. Most tables in recent years have been formed of metal, wood or plastics. Ordinarly, tables are constructed in a permanent form to provide a flat top surface supported above the ground by a plurality of fixed legs.

In addition to such permanent types of tables, tables have also been fabricated usually of wood or metal, where the table legs may be pivoted under the flat table surface. Examples of such tables are those called "card tables", or longer tables designed to be set up and used at banquets or other functions. All such tables however, are fairly heavy in weight and are not inexpensive. Considerable effort, thus, may be required to remove them from a storage space, to set them up and then dismantle them and return them to the storage space after they have been used for their particular functions.

Such collapsible tables, moreover, are normally large in size and are generally not made in small enough sizes for use in schools and children's playrooms. Consequently, tables for the latter purposes are usually fixed in nature and necessarily occupy considerable space even when they are pushed aside when they are not required for use by the children.

There has thus existed a considerable need for a light, inexpensive, but sturdy, table which can be stored at a minimum of space requirement, that may be easily carried and set up for intended use and dismantled and re-stored.

THE SUMMARY OF THE INVENTION

The present invention readily fills such existing needs in that a sturdy table may be provided which is light in weight, occupies a minimum of space when it is collapsed into flattened condition for storage, and may be easily set up. Further, it is most inexpensive to fabricate. The table may be made from a sheet of double-faced corrugated paper board which may be die cut both at its corners and in the central portion of each side to leave a member which projects from each corner of a rectangular center section which forms the table top. The corrugated board is creased for inward bending of the members with the intersections of the creases defining the corners of the table top, and the members are further angularly creased so that each portion may be bent for face-to-face engagement with its adjacent half. The ends of the members are slotted along the lines of the intersecting creases for a short distance inwardly from each extremity, with the result that, when the members are folded inwardly to extend at a 90 degree angle with respect to the table panel, the slots of the members are aligned and, by inserting a bent rectangular slotted element into the aligned slots, it will be found that legs of the table are effectively secured at a 90 degree angle with respect to the panel forming the table top. The result is a sturdy table, which in a small size, may be readily set up for use in a school or playroom, or, in a larger size, may be utilized as a card or game table; or indeed may be set up for some type of adult social or other function.

Because the table is fabricated of a corrugated board, at the time it is being die cut, it may be printed with either decorations, or a game board, such as checkers or the like.

After the table has served its purpose, it may be either trashed, or readily dismantled simply by removing the leg securing elements and flattening the legs and the table panel into a convenient configuration for storage or carrying away.

BRIEF DESCRIPTION OF THE DRAWINGS

In the accompanying drawings.

DESCRIPTION OF THE PREFERRED EMBODIMENT

The table of the present invention may be constructed from a single rectangular sheet 10 of double-faced corrugated paper board of at least 200 test C flute. From this sheet 10, by a die-cutting operation there is a removed from each corner 12*a*, 12*b*, 12*c* and 12*d* an almost square piece 14*a*, 14*b*, 14*c* and 14*d* respectively, the outside dimensions of each of which pieces are approximately equal to ¼ of the dimension of the shortest side of the rectangular sheet 10. Simultaneously, in the die-cutting operation there is also removed from the center 16*a*, 16*b*, 16*c*, 16*d* of each edge 18*a*, 18*b*, 18*c*, 18*d*, a slightly trapezoidal piece 20*a*, 20*b*, 20*c*, 20*d*, respectively, each having its inner linear dimension approximately equal to one quarter the original dimension of each edge 18*a*, 18*b*, 18*c*, 18*d* prior to the cut-out of any of the pieces 14*a*, 14*b*, 14*c* or 14*d*, or 20*a*, 20*b*, 20*c* and 20*d*.

Figure 1:
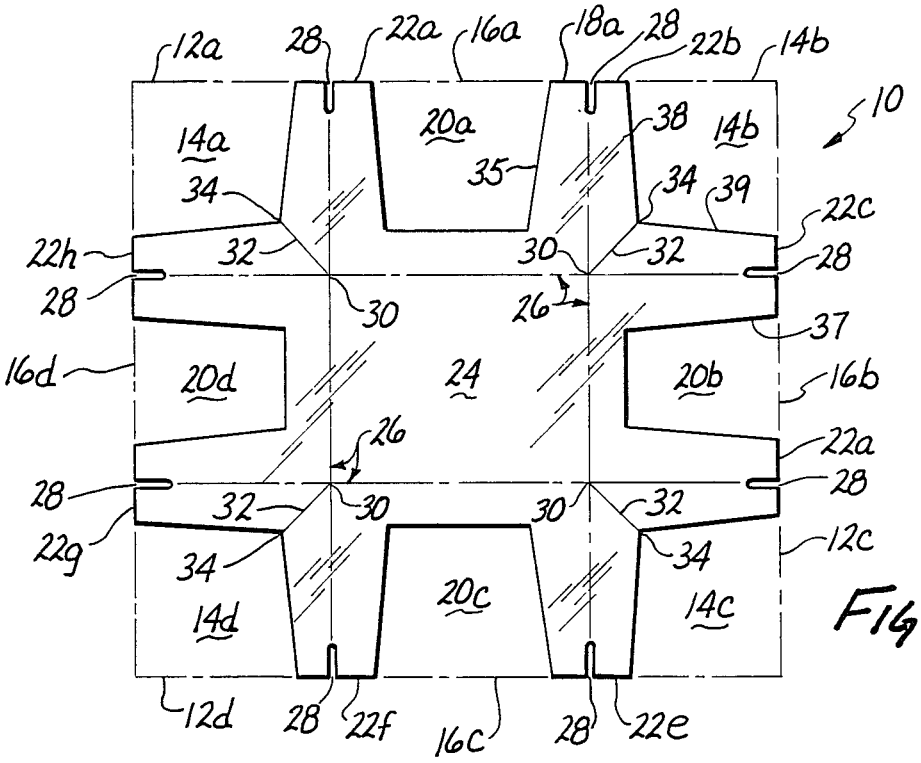
FIG. 1 is a plan view of a rectangular sheet which has been cut and creased in the manner required to enable the table to be formed.

As a result of these cut-outs from the rectangular sheet 10, as may be seen in FIG. 1, there are eight members 22*a*, 22*b*, 22*c*, 22*d*, 22*e*, 22*f*, 22*g*, 22*h* which extend from a central inner panel 24. Each oppositely extending pair of these members 22*a*, 22*b*, 22*c*, 22*d*, 22*e*, 22*f*, 22*g*, 22*h* is then impacted to form a crease 26 bisecting the respective oppositely extending pairs of said members. Each said member 22*a*, 22*b*, 22*c*, 22*d*, 22*e*, 22*f*, 22*g*, 22*h* is further cut to form a slot 28 which extends for a short distance inwardly along the creased line 26.

The intersections of the creased lines 26 become the corners 30 of the central panel 24 which will constitute the table top.

In addition, further creasing or breaking of the corrugation is effected along a line extending between each corner 30 of the table top and the inner corner 34 left by the removal of the corner pieces 14*a*, 14*b*, 14*c* and 14*d*.

Figure 2:
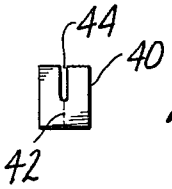
FIG. 2 is a slotted rectangular securing element.

At the time of the removal of either of the corner pieces 14*a*, 14*b*, 14*c*, 14*d* or the central edge areas 20*a*, 20*b*, 20*c*, 20*d*, the die may also simultaneously cut from such removed pieces four small rectangular pieces 40, an exemplar of which is shown in FIG. 2, which may be simultaneously bisected by a crease 42 and partially slotted at 44.

Figure 3:
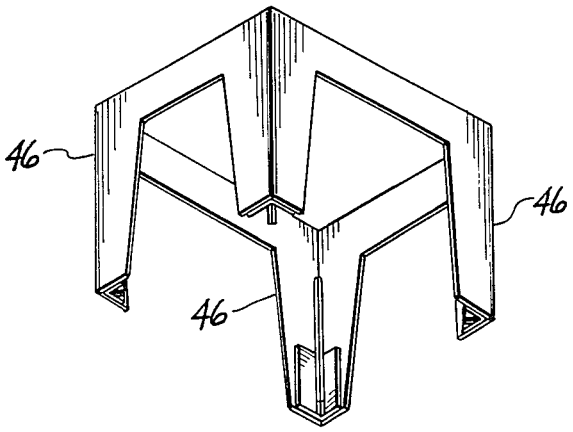
FIG. 3 is a perspective view looking up from below the table as it has been assembled.

The table is now ready for assembly and this is accomplished by bending inwardly along the crease lines 26, all remaining portions of the sheet 10 outside of the perimeter of the panel 24. It will be found that with such bending, adjacent pairs of members (e.g. *22b, 22c, 22d, 22e,* etc.) extending off each corner 30 of the panel 24, will come together to present their most adjacent sides (e.g. 38 of member *22b* and 39 of *22c*) in face-to-face engagement at a 45 degree angle to the other half of each member with the non-engaging sides (e.g. 35, 37) of the members (e.g. *22b, 22c,* respectively) coming together to form a 90 degree corner with their slots 28 in register. By then bending each of the small slotted panel members 40 to a 45 degree angle and pushing its slotted edge 44 down into the registering slots 28 of one of the corner members, *22a, 22b, 22c, 22d, 22e, 22f, 22g, 22h,* as shown in FIG. 3, it will be found that effective rigid corner posts 46 result to provide the panel member 24 with four rigid supporting corner posts 46, as shown in FIG. 3. At this point the assembly may be inverted and set down on the floor to become a sturdy table.

Disassembly may easily be accomplished by simply removing the small slotted panel member 40 from the bottom of each post 46 and then folding two opposite sides against the underside of the panel 24, thereby to produce a flattened member of a H-shaped configuration which may be readily carried away and stored or packed in some type of flat container.

The present invention thus lends itself to mass producing a very inexpensive readily assemblable and disassemblable corrugated paper board table. The table may be made in small sizes for the use of children either at home or in school, or it may be made in a larger size and desirably with a heavier and more rigid corrugated paper board to serve as a picnic table, a game table, or temporary table for many other uses.

Because the table is made of a corrugated paperboard it may have printed upon it decorations, games, advertisements, or other visual matter.

Since the table may be is readily mass produced from low cost materials, it may be marketed at a very inexpensive price, with the result that, in situations where it may not be convenient to disassemble the table and carry it back for storage, it may simply be disposed of, or left in situ for use by others.

What is claimed is:

1. A disassemblable table having a rectangular top surface supported by four legs extending downwardly from each corner of said surface, said table being formed of a single rectangular sheet of corrugated paper board material from each corner which has been removed an approximately square shaped piece having a side dimension in the order of $\frac{1}{4}$ of the shortest side dimension of said sheet, and from which sheet has further been removed from the center of each side edge, a trapezoid piece having an inner side dimension which is also approximately $\frac{1}{4}$ the dimension of the side of the sheet from which the said trapezoid piece has been removed, said removals leaving along each side of the rectangular sheet, two projecting members spaced from each other by the last said approximately $\frac{1}{4}$ distance, and each said member in width being approximately $\frac{1}{8}$ of the side dimension of the sheet, said sheet being creased for inward folding along lines bisecting each of said projecting members, the intersections of said creases defining the four corners of a panel comprising the rectangular table top; said sheet being further creased at a 45 degree angle outwardly from each of said intersections also for inward folding, each of said members being slotted for a short distance inwardly from its outer extremity along its crease or fold line; whereby when each of said member is bent inwardly to assume a 90 degree angle with said panel, $\frac{1}{2}$ of each member will be brought into face-to-face abutment with an adjacent half of its most proximate member with their slottings in register, to form one leg projecting downwardly from the panel forming the table top; each said pair of face-to-face engaged members being secured together by a small rectangular element folded to a 90 degree angle and slotted from one edge inwardly along its fold, said element having its slotting inserted in the registering slottings of said pair of abutting face-to-face engaged members.

2. The table as described in claim 1 wherein the rectangular element securing each pair of face-to-face engaged members is of a corrugated board.

3. The table as described in claim 1 wherein the sheet from which it is formed is a double faced at least 200 test C flute corrugated board.

* * * * *